US005918980A

United States Patent [19]

Bauermeister et al.

[11] Patent Number: 5,918,980

[45] **Date of Patent: *Jul. 6, 1999**

[54] CONCRETE PLACER ATTACHMENT FOR SKID STEER LOADERS

[76] Inventors: Anton J. Bauermeister, 5810 Walnut St., Omaha, Nebr. 68106; Mark J. Parkert, 4807 Cass St. #5, Omaha, Nebr. 68152

[ * ] Notice: This patent is subject to a terminal disclaimer.

[21] Appl. No.: 08/912,353

[22] Filed: Aug. 18, 1997

Related U.S. Application Data

[63] Continuation of application No. 08/675,543, Jul. 3, 1996, Pat. No. 5,669,712.

[51] Int. Cl.[6] ..... B01F 15/02; B28C 7/16

[52] U.S. Cl. ..... 366/349; 366/51; 222/145.1

[58] Field of Search ..... 366/348, 349, 366/51, 2, 9, 10; 222/135, 145.1, 145.4, 386

[56] References Cited

U.S. PATENT DOCUMENTS

| | | | |
|---|---|---|---|
| 2,316,705 | 4/1943 | Morgan et al. | 366/2 |
| 3,091,438 | 5/1963 | Hembree | 366/10 |
| 3,485,481 | 12/1969 | Zimmerman | 366/51 |
| 3,705,710 | 12/1972 | Mueller | 222/145.4 |
| 3,807,706 | 4/1974 | Kugle et al. | 366/51 |
| 4,097,925 | 6/1978 | Butler, Jr. | 366/2 |
| 4,147,331 | 4/1979 | Kopecky | 366/51 |
| 4,185,924 | 1/1980 | Graham | 366/10 |
| 4,387,995 | 6/1983 | Routson | 366/2 |

*Primary Examiner*—Tony G. Soohoo
*Attorney, Agent, or Firm*—Zarley,McKee,Thomte,Voorhees & Sease; Dennis L. Thomte

[57] ABSTRACT

A concrete placer for attachment to a skid steer loader which runs only off the auxiliary hydraulics and electric power of the skid steer loader. The concrete placer comprises a hopper, a concrete pump frame, two concrete pumping cylinders, and a small hydraulic cylinder and swing valve assembly which together control movement of a swing valve to alternately receive concrete from each of the two concrete pumping cylinders and discharge it from a porthole in the hopper.

1 Claim, 3 Drawing Sheets

CONCRETE PLACER ATTACHMENT FOR SKID STEER LOADERS

CROSS-REFERENCE TO RELATED APPLICATION

This is a continuation of U.S. Ser. No. 08/675,543, filed Jul. 3, 1996 now U.S. Pat. No. 5,669,712.

BACKGROUND—FIELD OF INVENTION

This invention relates to the field of attachments for skid steer loaders, specifically to a concrete pump which runs only off the auxiliary hydraulics and electrical power of a skid steer loader. Applications may include, but are not limited to, placing concrete in hard to reach areas.

BACKGROUND—DESCRIPTION OF PRIOR ART

It is known to have concrete pumps. It is also known to have attachments for skid steer loaders, including a demolition hammer as shown and described in U.S. Design Pat. No. 302,558 to Davis (1989), a device for harvesting and loading or unloading and installing large rolls of sod as disclosed in U.S. Pat. No. 5,437,528 to Decker (1995), and backhoe mounting devices and attachments as disclosed in U.S. Pat. No. 5,004,398 to Wagner (1991) and U.S. Pat. No. 5,171,124 to Foster (1992), respectively. However, none of these devices alone or in combination, teach a cement placer with the same design specifications as the present invention which allow it to be attached to a skid steer loader and have its concrete pumps run only off the auxiliary hydraulics and electrical power of the skid steer loader.

SUMMARY OF THE INVENTION

It is the primary object of this invention to provide a concrete placer which is lower in cost than conventional trailer mounted concrete pumps and thereby more affordable to contractors. It is also an object of this invention to provide a concrete placer which runs only off the auxiliary hydraulics and electrical power of a skid steer loader, resulting in a concrete placer having fewer components than conventional trailer mounted concrete pumps, one that is less expensive to construct and one which meets weight restrictions required for use with a skid steer loader. A further object of this invention is to provide a concrete placer for a skid steer loader which weighs less than 1750 pounds. It is also an object of this invention to provide a concrete placer for a skid steer loader so as to be able to pump concrete into hard to reach areas.

As described herein, properly manufactured, and attached to a skid steer loader, the present invention would provide a means of pumping concrete into hard to reach places. The concrete pumps of the present invention would run only off the auxiliary hydraulics and electrical power of the skid steer loader. The preferred embodiment of the present invention would comprise a hopper having an approximate eight and one-half cubic foot capacity, adjustable jack stands for stabilizing the present invention during pumping, a concrete pump having two concrete pumping cylinders and pistons, a swing valve, and swing valve assembly for movement of the swing valve so as to alternate communication of the swing valve bore with each of the concrete pumping cylinders. Since the present invention uses the auxiliary hydraulics and electrical power of the skid steer loader it is less expensive to manufacture than conventional trailer mounted concrete pumps and thereby more affordable to contractors The present invention also has fewer components and is thereby lighter in weight than conventional trailer mounted concrete pumps so as to meet weight restrictions required for use with a skid steer loader.

The description herein provides preferred embodiments of the present invention but should not be construed as limiting the scope of the concrete placer invention. For example, variations in the exact size and shape of the hopper, size and slope of the splash guard, the number of adjustable jack stands used, the configuration, size, and number of agitators used to prevent the concrete in the hopper from becoming compacted, the size and configuration of the clean-out hatch, the size and configuration of the piston access box and the configuration of the concrete pump frame, other than those shown and described herein, may be incorporated into the present invention as long as the total weight of the present invention does not exceed the 1750 pound weight limit required for use with a skid steer loader. Thus the scope of the present invention should be determined by the appended claims and their legal equivalents, rather than the examples given.

DESCRIPTION OF THE PREFERRED EMBODIMENT

Figure 1:
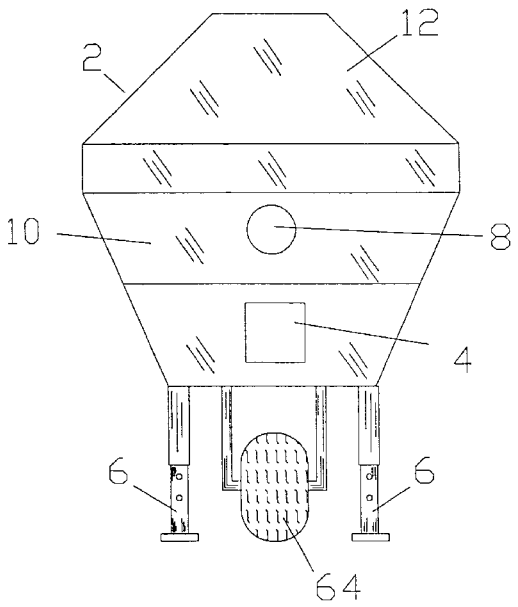
FIG. 1 is a front view of the invention having a hopper, a splash guard, adjustable jack stands, and a porthole through which concrete is discharged from the hopper.
Figure 2:
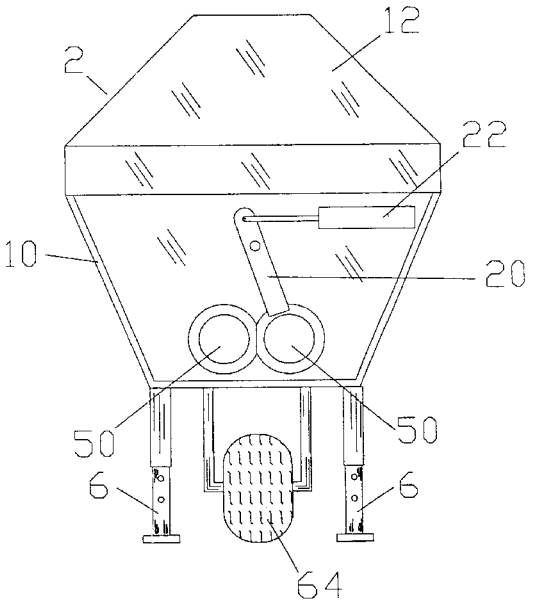
FIG. 2 is a sectional view of the invention having a small hydraulic cylinder connected to a swing valve assembly adjacent to the hopper.

FIGS. 1 and 2 show a preferred embodiment of a concrete placer invention 2 having a hopper 10 supported on adjustable jack stands 6 and a wheel 64. Jack stands 6 support concrete placer invention 2 during pumping and centrally positioned wheel 64 helps in moving concrete placer invention 2 from one location to another, as well as during loading of concrete placer invention 2 onto a trailer. Although one wheel 64 is shown, it is contemplated to have more than one wheel 64 attached to the bottom of hopper 10. A clean-out hatch 4, with hinged doors which pivot downward into an opened position, is centrally located through the bottom of hopper 10 and a splash guard 12 depends upwardly from the upper surface of the back wall of hopper 10. Although not shown, in the preferred embodiment it is contemplated for clean-out hatch 4 to have hinged doors which lock into a closed position during use. FIG. 1 also shows a flanged porthole 8 positioned through the front wall of hopper 10 through which concrete (not shown) placed into hopper 10 is ultimately pumped. During use it is contemplated for a concrete discharge hose (not shown) to be connected to flanged porthole 8. In the preferred embodiment it is contemplated for flanged porthole 8 to have an outer diameter of approximately six inches, an inside diameter of approximately five inches, and a seven inch bolt flange holder attached thereto with extra bolts (not shown) for thrust bearing adjustment.

FIG. 2 shows a small hydraulic cylinder 22 attached to one end of a swing valve assembly 20 and two adjacent concrete pumping chamber openings 50 positioned through the back wall of hopper 10. In the preferred embodiment it is contemplated for small hydraulic cylinder 22 to have a one inch bore and a four inch stroke so as to cause swing valve assembly 20 to swing alternately from one concrete pumping chamber opening 50 to the adjacent concrete pumping chamber opening 50.

In the preferred embodiment it is contemplated for hopper 10 to hold approximately eight and one-half cubic feet of concrete (not shown). Also, although not shown, it is also contemplated in the preferred embodiment for the top portion of hopper 10 to comprise three-sixteenths inch thick plate steel and the bottom portion of hopper 10 to comprise three-fourths inch thick plate steel. The top portion of hopper 10 is bolted to the bottom portion of hopper 10 for secure attachment. Adjustable jack stands 6 stabilize hopper 10 during concrete pumping and are shown in both FIGS. 1 and 2. In the preferred embodiment it is contemplated to have four adjustable jack stands 6, with two adjustable jack stands 6 supporting the front of hopper 10 and two adjustable jack stands 6 supporting the end of a concrete pump frame, shown as number 32 in FIG. 3, which is remote from hopper 10. Also, it is contemplated in the preferred embodiment for adjustable jack stands 6 to be made of steel tubing having an inside diameter between two and two-and-one-half inches, with a one-fourth inch wall thickness. Since it is not required for splash guard 12 to hold any pumping force, and due to the overall 1750 pound weight restriction placed on concrete placer invention 2, splash guard 12 should be made of a thin and lightweight material. In the preferred embodiment it is contemplated for splash guard 12 to comprise three-sixteenths inch thick plate steel. A logo, or other type of design, may be placed on splash guard 12.

Figure 3:
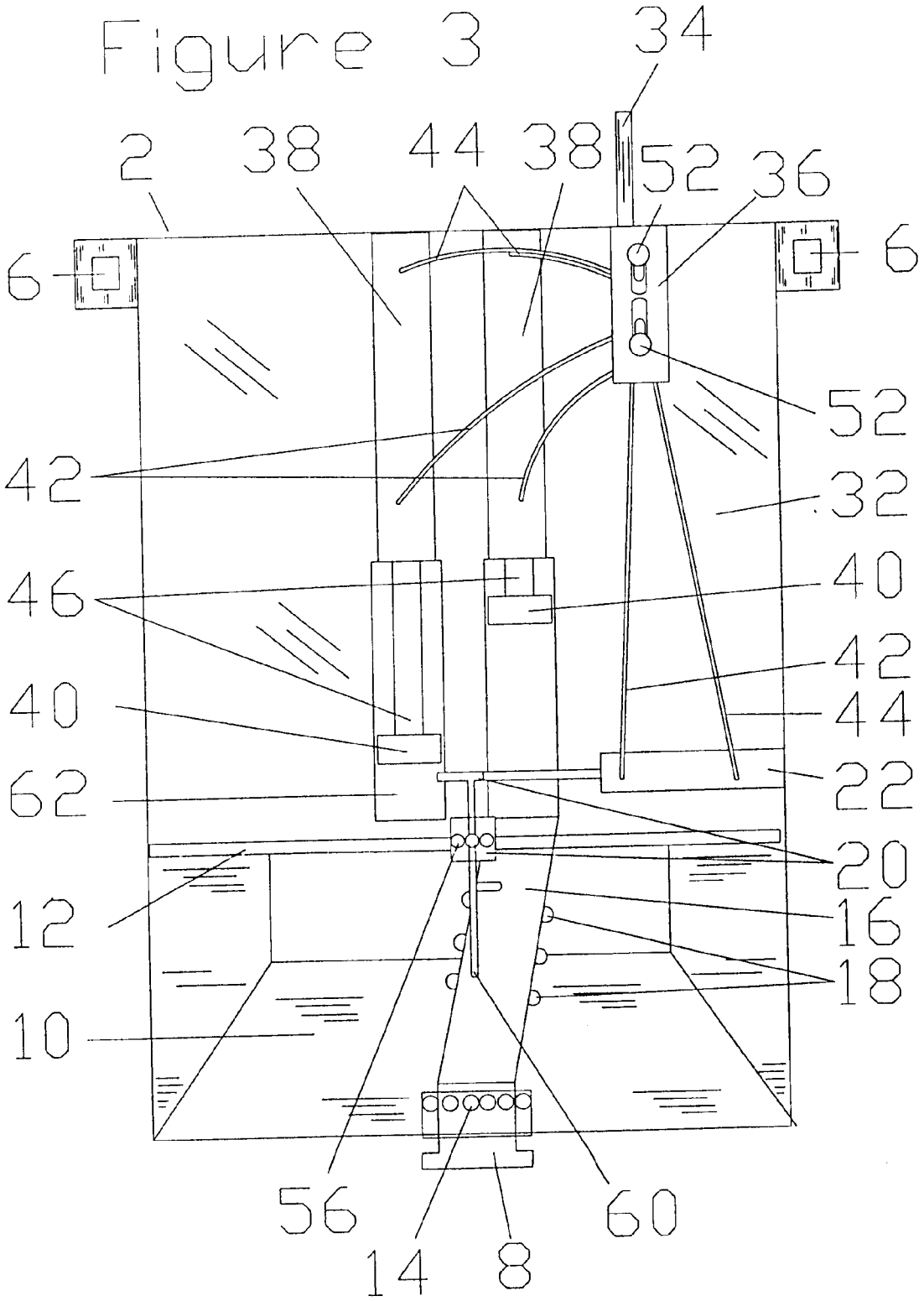
FIG. 3 is a top view of the invention.
Figure 4:
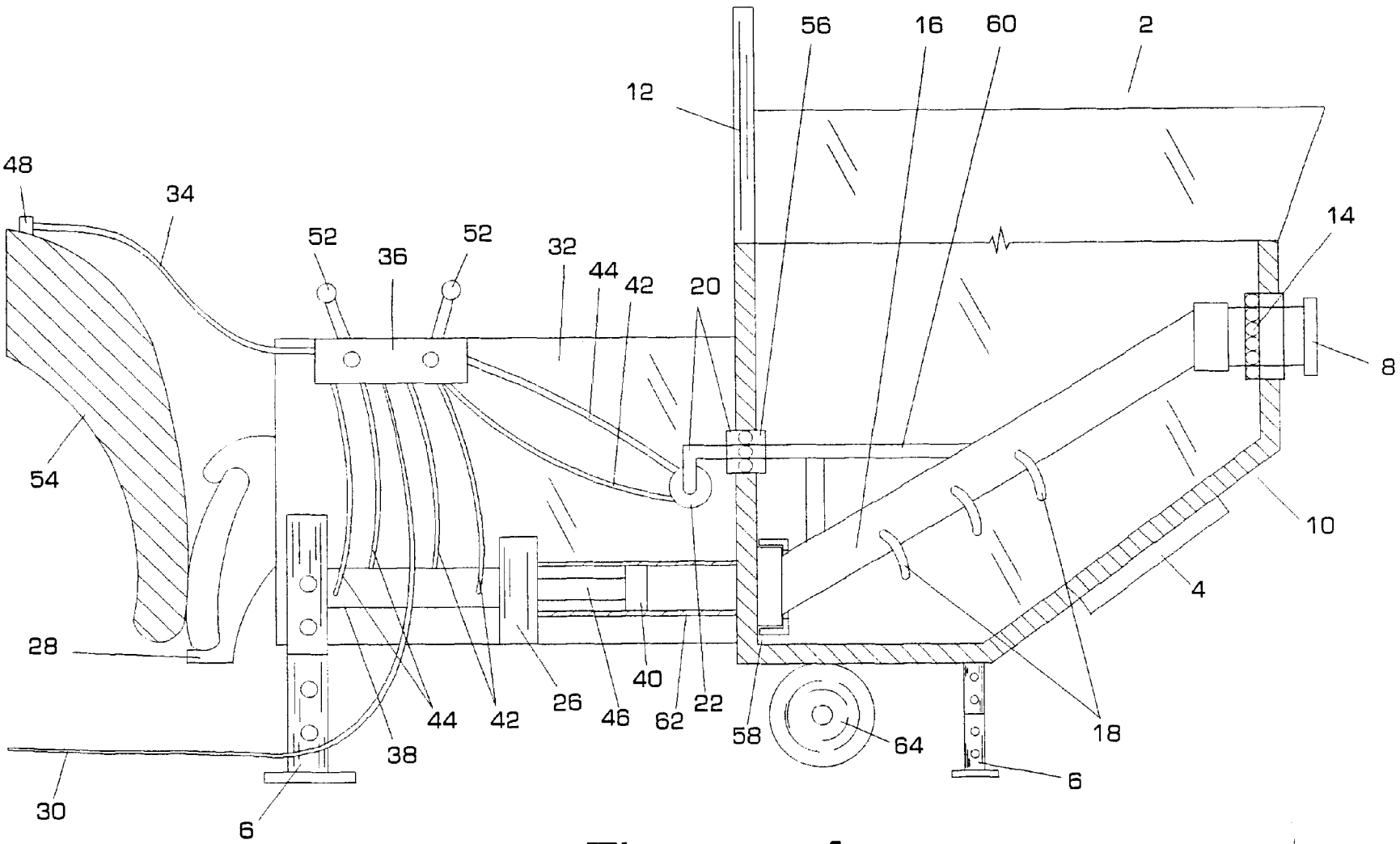
FIG. 4 is a side view of the invention attached to a skid steer loader.

FIGS. 3 and 4 show the preferred embodiment of concrete placer invention 2 having hopper 10 attached to concrete pump frame 32 with splash guard 12 in an upwardly depending position therebetween. FIGS. 3 and 4 also show concrete placer invention 2 having four adjustable jack stands 6, two adjustable jack stands 6 attached to the front of hopper 10 and two adjustable jack stands 6 attached to the back of concrete pump frame 32, so that each adjustable jack stand 6 is placed in support of one outside corner of concrete placer invention 2. Flanged porthole 8 is positioned through a portion of the upper front wall of hopper 10 which is vertical. Above flanged porthole 8, the front wall of hopper 10 extends at an angle upwardly and away from the back wall of hopper 10. Below flanged porthole 8, the front wall of hopper 10 extends at an angle downwardly and toward the back wall of hopper 10, connected at its lower end to the front edge of the bottom of hopper 10. Clean-out hatch 4 is positioned through the downwardly and rearwardly sloping portion of the front wall of hopper 10. Swing valve 16 is connected to flanged porthole 8 with thrust bearing 14 connected therebetween immediately behind the front wall of hopper 10. Several agitators 18 are attached to the outside surface of swing valve 16 to keep the concrete (not shown) in hopper 10 from becoming compacted. The size, number, and configuration of agitators used is not critical to concrete placer invention 2. However, in the preferred embodiment it is contemplated to have six agitators 18 which are hook-like in configuration and made from one-half inch thick steel. A swing valve assembly 20 is attached between swing valve 16 and small hydraulic cylinder 22 to move the interior chamber of swing valve 16 alternately into communication with each concrete pumping chamber opening 50. FIGS. 3 and 4 also show an auxiliary hydraulic line 34 connected through concrete pump frame 32 to a control box 36 and several control levers 52 connected through the upper portion of control box 36. In the preferred embodiment it is contemplated for control levers 52 to comprise a solenoid control and a manual lever for forward and reverse operation, and for a flow control dial (not shown) to also be connected to control box 36. FIGS. 3 and 4 show hydraulic lines and fittings 42, as well as extend piston hydraulic lines 44, to connect small hydraulic cylinder 22 to control box 36 and control levers 52.

FIGS. 3 and 4 also show large hydraulic cylinders 38 positioned lengthwise through concrete pump frame 32. Although not shown, in the preferred embodiment it is contemplated for each large hydraulic cylinder 38 to be bolted to the back of hopper 10 with tie rod bolts. Attached through the front end of each large hydraulic cylinder 38 is an actuator arm 46, with a pumping piston 40 attached to the distal end of each actuator arm 46. Each pumping piston 40 and actuator arm 46 is positioned to move within a concrete pumping chamber 62. Since skid steer loaders 54 are currently constructed with two levels of hydraulic flow, regular flow which provides approximately twelve to fifteen gallons per minute and high flow which provides approximately twenty to twenty-four gallons per minute, in the preferred embodiment it is contemplated to have two different sizes of large hydraulic cylinders 38 depending on which type of skid steer loader 54 is used. For connection to skid steer loader 54 having a regular flow hydraulic system, large hydraulic cylinder 38 would have a twenty-four inch stroke and two inch bore, and for connection to skid steer loader 54 having a high flow hydraulic system, large hydraulic cylinder 38 would have a twenty-four inch stroke and a two-and-one-half inch bore. However, in either preferred embodiment of concrete placer invention 2, it is critical that each large hydraulic cylinder 38 have the same pumping capacity. In the preferred embodiment it is contemplated for each concrete pumping chamber 62 to be twentyfive inches long, firmly bolted to the back wall of hopper 10, have a five inch inside diameter with one-fourth inch thick walls, and an interior which is honed out to be smooth. Although not shown, for longer life, in the preferred embodiment it is contemplated for the bores of each concrete pumping chamber 62 to be hard chrome plated.

Also in the preferred embodiment, although not shown, it is contemplated for pumping pistons 40 to be attached to actuator arms 46 by threads and lock nuts, to be three inches thick and five inches in diameter, and to have been machined to the inside walls of concrete pumping chambers 62. Further, in the preferred embodiment, although not shown, it is contemplated for piston caps to be attached to each pumping piston 40 for wiping the walls of concrete pumping chambers 62 and for the piston caps to be made from TEFLON® machined not only to fit the face of each pumping piston 40, but the main diameter of each pumping piston 40 in two places. It is contemplated for the piston caps to be replaceable parts since they will wear over time.

FIG. 4 shows a mounting plate 28 attaching concrete pump frame 32 to skid steer loader 54. In the preferred embodiment it is contemplated for mounting plate 28 to have a variety of configurations depending on the manufacturer and model of the selected skid steer loader 54 used for connection to concrete placer invention 2. In addition, FIG. 4 shows auxiliary hydraulic line 34 connected to a hydraulic connector 48 on skid steer loader 54, a piston access box 26 connected between each large hydraulic cylinder 38 and adjacent concrete pumping chamber 62 and an electrical cord 30 having a battery adapter (not shown) on its distal end for connection between the battery terminals (not shown) of skid steer loader 54 and control box 36. Although concrete placer invention 2 is connected to the electrical system of the skid steer loader (not shown) through the skid steer loader's battery, it is contemplated for concrete placer invention 2 to operated from power generated by the skid steer loader's engine and transferred to concrete placer invention 2 via the skid steer loader's alternator (not shown). In the preferred embodiment it is contemplated for piston access box 26 to be five inches wide, one foot four inches in length, and eight inches in height, and to be made from three-fourths inch plate steel with hinges at its top for access to pumping pistons 40 for their repair, lubrication, and maintenance. In the preferred embodiment, although not shown, it is contemplated for electrical cord 30 to be approximately twelve feet in length and control box 36 to be operable through the twelve volt battery (not shown) of skid steer loader 54 so as to run a twelve volt solenoid, gauges, a remote control, and an on-off switch for pumping pistons 40.

In the preferred embodiment it is contemplated for concrete pump frame 32 to be made of two inch by two inch tube steel having one-fourth inch thick walls. In the preferred embodiment it is also contemplated for thrust bearing 14 to have a five-and-one-half inch inside diameter and a seven inch outside diameter, which is adjustable by bolts (not shown) for connection to flanged porthole 8 and which holds the bore of swing valve 16 in constant communication with flanged porthole 8 undisturbed by the forces associated with concrete pumping. Although not shown, it is also contemplated to have a tough plastic ring to seat and protect thrust bearing 14. In the preferred embodiment it is contemplated for swing valve 16 to have a five inch inside diameter, a five-and-one-half inch outside diameter, and a seven inch bolt flange attached thereto for connection to thrust bearing 14. The rearward end of swing valve 16 has a wear plate 58 made of work hardening steel one-half inch thick so that swing valve 16 may be lined up with a one-half inch thick work hardening steel wear plate (not shown) positioned alternately against each concrete pumping chamber opening 50. In the preferred embodiment it is also contemplated for small hydraulic cylinder 22 to be two inches in diameter and six inches in length, and to be time actuated by an electric solenoid (not shown).

To use the preferred embodiment of concrete placer invention 2, one must attach mounting plate 28 on concrete pump frame 32 to a skid steer loader 54. As shown in FIGS. 1–4 and described herein, concrete placer invention 2 weighs approximately 1300 pounds, less than the 1750 pound limit required for use with a skid steer loader 54. Adjustable jack stands 6 are set to stabilize and support concrete pump frame 32 and hopper 10 during pumping operations. Auxiliary hydraulic line 34 is attached to hydraulic connector 48 on skid steer loader 54 and electrical cord 30 is attached to the battery terminals (not shown) of skid steer loader 54 so that concrete placer invention 2 may draw electrical power for operation from the running engine of skid steer loader 54 via its alternator (not shown). Concrete (not shown) is then placed into hopper 10. Gravity forces the concrete into the bottom of hopper 10. An on-off switch (not shown), or a remote control device (not shown) is engaged to activate pumping pistons 40. As the gravity fed concrete moves into each concrete pumping chamber 62, small hydraulic cylinder 22 causes swing valve assembly 20 to alternately move in front of each concrete pumping chamber 62, after which the associated pumping piston 40, forces the concrete from each concrete pumping chamber 62 into swing valve 16 and ultimately out of flanged porthole 8 into a concrete discharge hose (not shown). The bottom of hopper 10 must be entirely constructed of three-fourths inch thick steel plate so as to hold swing valve 20 and thrust bearing 14 in an essentially non-moving, rigid fashion during the very intense pressures resulting from pumping operation. Swing valve 20 must also be able to shear rocks and gravel up to up to one-and-one-half inches in diameter which become caught in the path of concrete pumping chamber openings 50 as swing valve 20 moves into alternate pumping positions in front of each concrete pumping chamber opening 50. When operation of concrete placer invention 2 is concluded, clean-out hatch 4 may be used to evacuate the remaining concrete from hopper 10 and allow rinsing of the interior of hopper 10 with water (not shown).

We claim:

1. A concrete placer for attachment to a prime mover having hydraulics and electrical power, comprising:

a hopper having a front wall and a back wall;

a discharge porthole formed through the front wall;

a plurality of openings formed through the back wall;

a concrete pump frame attached to said hopper;

a support structure attached to the hopper and pump frame for supporting the hopper and frame on the ground;

a plurality of concrete pump chambers positioned within the pump frame, each chamber having a bore communicating with said hopper through one of said plurality of openings;

an operable valve having opposing first and second ends and an interior chamber extending between the ends, the first end positioned against the discharge porthole for continuous communication of the valve chamber therewith, and the second end movable among the plurality of openings for periodic communication of the valve chamber with each of the pumping chambers through each of the openings;

a plurality of hydraulic pump cylinders operably mounted on said pump frame, each pump cylinder associated with each of said pump chambers;

each pump cylinder including a piston mounted for reciprocating movement through the associated pump chamber for pushing concrete with the chamber out through the valve chamber;

means connected to said valve for moving the valve second end alternately among each of said openings;

a plurality of hydraulic lines for connection between the prime mover hydraulics and said pump cylinders;

a control box connected to the hydraulic lines for selectively activating the pump cylinders; and an electric cord connected to the control box, for connection of the control box to the electrical power of the prime mover.

* * * * *